US005172823A

United States Patent [19]

Moetteli

[11] Patent Number: 5,172,823

[45] Date of Patent: Dec. 22, 1992

[54] COMBINATION DUSTPAN AND TRAPDOOR RECEPTACLE CLOSURE

[76] Inventor: John B. Moetteli, 11524 Royalshire Dr., Dallas, Tex. 75230

[21] Appl. No.: 635,272

[22] Filed: Dec. 28, 1990

[51] Int. Cl.[5] ..... B65D 90/00

[52] U.S. Cl. ..... 220/334; 220/908; 15/257.3

[58] Field of Search ..... 220/334, 908, 85 D; 15/257.1, 257.2, 257.4, 257.3

[56] References Cited

U.S. PATENT DOCUMENTS

| | | | |
|---|---|---|---|
| 509,689 | 11/1893 | Sarchet | 15/257.3 |
| 1,984,228 | 12/1934 | Morhous | 220/334 X |
| 2,237,836 | 4/1941 | Macaluso | 15/257.4 |
| 3,056,992 | 10/1962 | Clough | 15/257.3 |
| 3,072,245 | 1/1963 | Faltin | 206/19.5 |
| 3,156,941 | 11/1964 | Tomaiuolo | 15/257.1 |
| 3,306,486 | 2/1967 | Martino et al. | 220/334 X |
| 3,382,523 | 5/1968 | Parsisson | 15/257.2 |
| 3,390,804 | 7/1968 | Morgan | 220/908 X |
| 3,408,681 | 11/1968 | Isakson | 15/257.2 |
| 4,600,113 | 7/1986 | DeMars | 220/908 X |

FOREIGN PATENT DOCUMENTS

| | | | |
|---|---|---|---|
| 682465 | 3/1964 | Canada | 220/908 |

*Primary Examiner*—Steven M. Pollard

[57] ABSTRACT

A combination dustpan and trapdoor receptacle closure having a handle and hinge means to allow pivotal mounting on the receptacle such that removal of the closure from the receptacle isn't necessary in order to deposit refuse in the receptacle and such that the hands need not come into direct contact with the possibly soiled closure surface in order to access the inside of the receptacle, said closure further characterized by a spade-like edge to aid in the movement of refuse toward the central area of the closure when said closure is removed from the receptacle and used as a dustpan.

5 Claims, 4 Drawing Sheets

COMBINATION DUSTPAN AND TRAPDOOR RECEPTACLE CLOSURE

This invention relates generally to a combination dustpan and trapdoor receptacle closure, more particularly it relates to a receptacle closure characterized by a spade-like edge to aid in the movement of refuse toward the central area of the closure when said closure is removed from the receptacle and used as a dustpan, said closure further having a handle and hinge means to allow pivotal mounting on the receptacle such that removal of the closure from the receptacle isn't necessary in order to deposit refuse in the receptacle and such that the hands need not come into direct contact with the possibly soiled closure surface in order to access the inside of the receptacle.

One may safely assume that the majority of households contain dustpans which are stored in a remote recess until such a time as their function is required. When needed they must be retrieved from this recess, serve their purpose, and then be returned to storage after having been emptied into the waste receptacle. This is often inconvenient. Accordingly, an object of the invention is in the provision of a dustpan formed to serve as the closure of a waste receptacle whereby it is stored at the most convenient location, the final point of use. Also, because the dustpan and trapdoor receptacle closure are combined into one piece, the opening to the waste receptacle is unobstructed when the user empties the contents of the dustpan into the waste receptacle. Accordingly, an object of the invention is to provide a more efficient dustpan.

A further object of this invention is the provision of a receptacle closure or trap door which holds in any unpleasant odors while allowing self-closing feature and a handle for remotely accessing the inside of the receptacle for its intended purpose that of storing refuse. This is accomplished by the pivotally mounting of said closure either in a secondary bonnet covering the receptacle's major opening or directly over the opening itself, combined with the dual use of the integrally mounted handle as a dustpan handle and as a remote lever for sanitarily accessing the inside of the receptacle, thereby avoiding the need to touch the closure face with the bare hand as is normally necessary when a conventional trapdoor receptacle closure is used.

Other objects and advantages of this invention will become readily apparent as the same is better understood by reference to the following detailed description when considered in connection with the accompanying drawings wherein.

Figure 1:
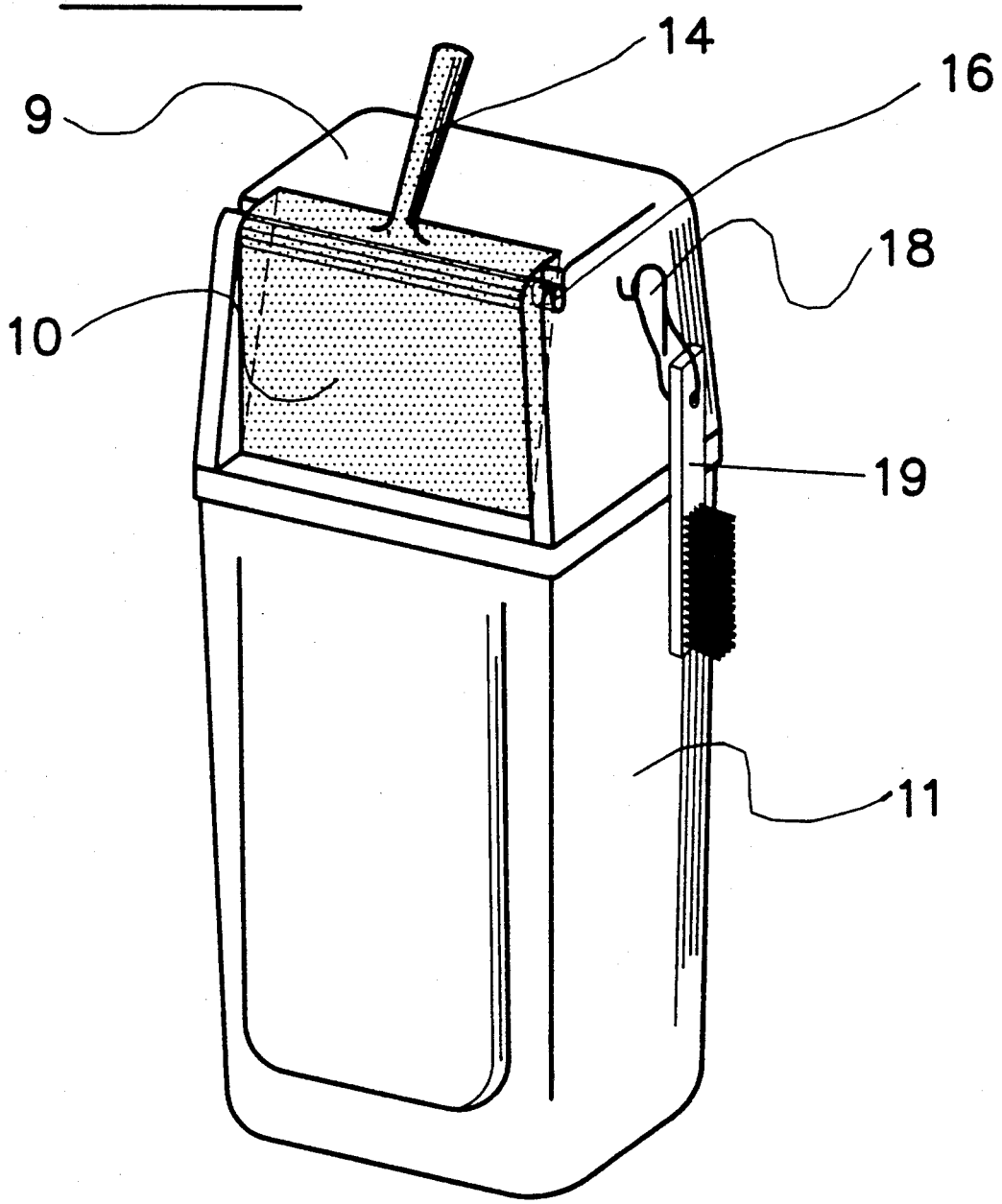
FIG. 1 is a perspective view showing a dustpan and trapdoor receptacle closure mounted on and covering a waste receptacle.
Figure 2:
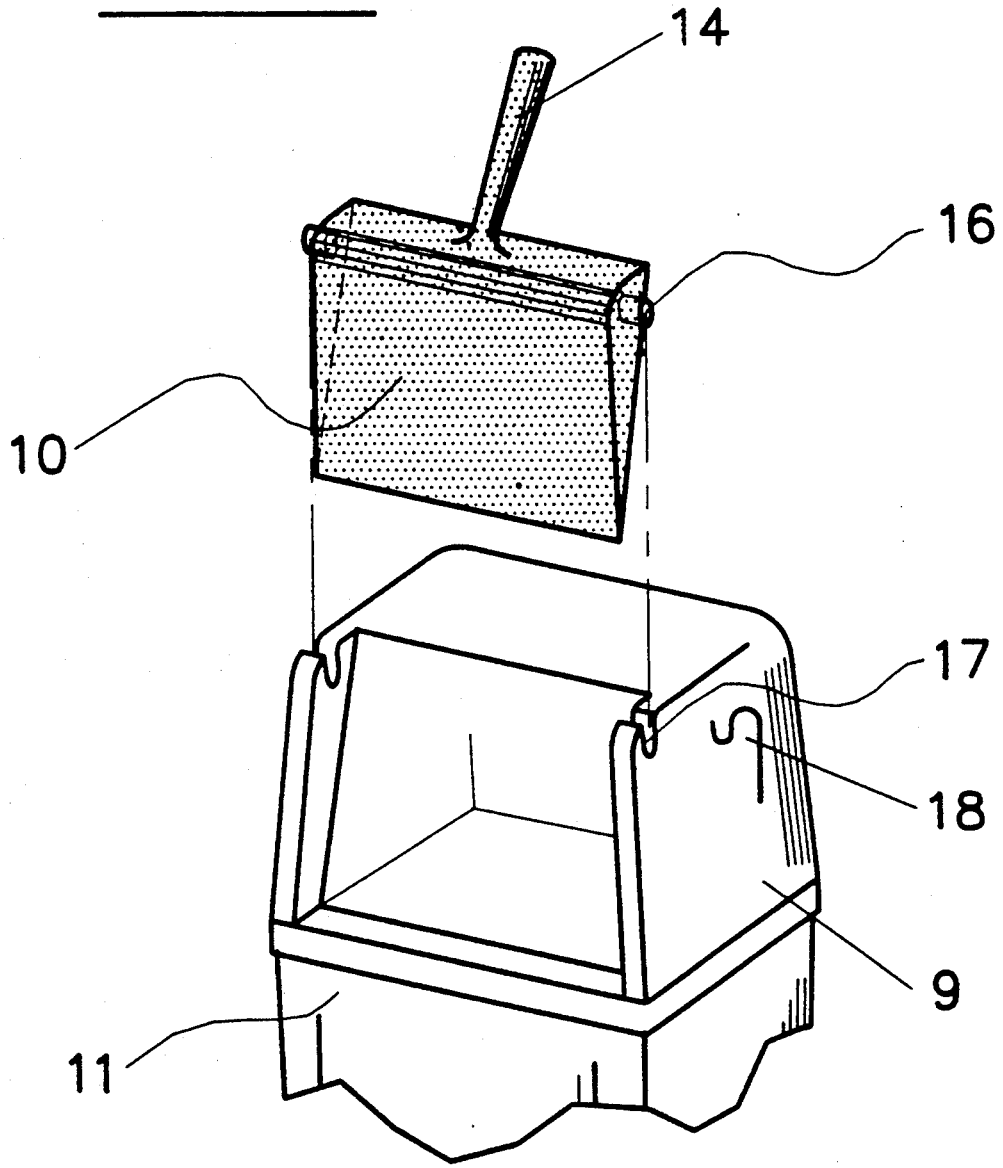
FIG. 2 is a perspective view of the dustpan and trapdoor receptacle closure as it is removed from the waste receptacle.
Figure 3:
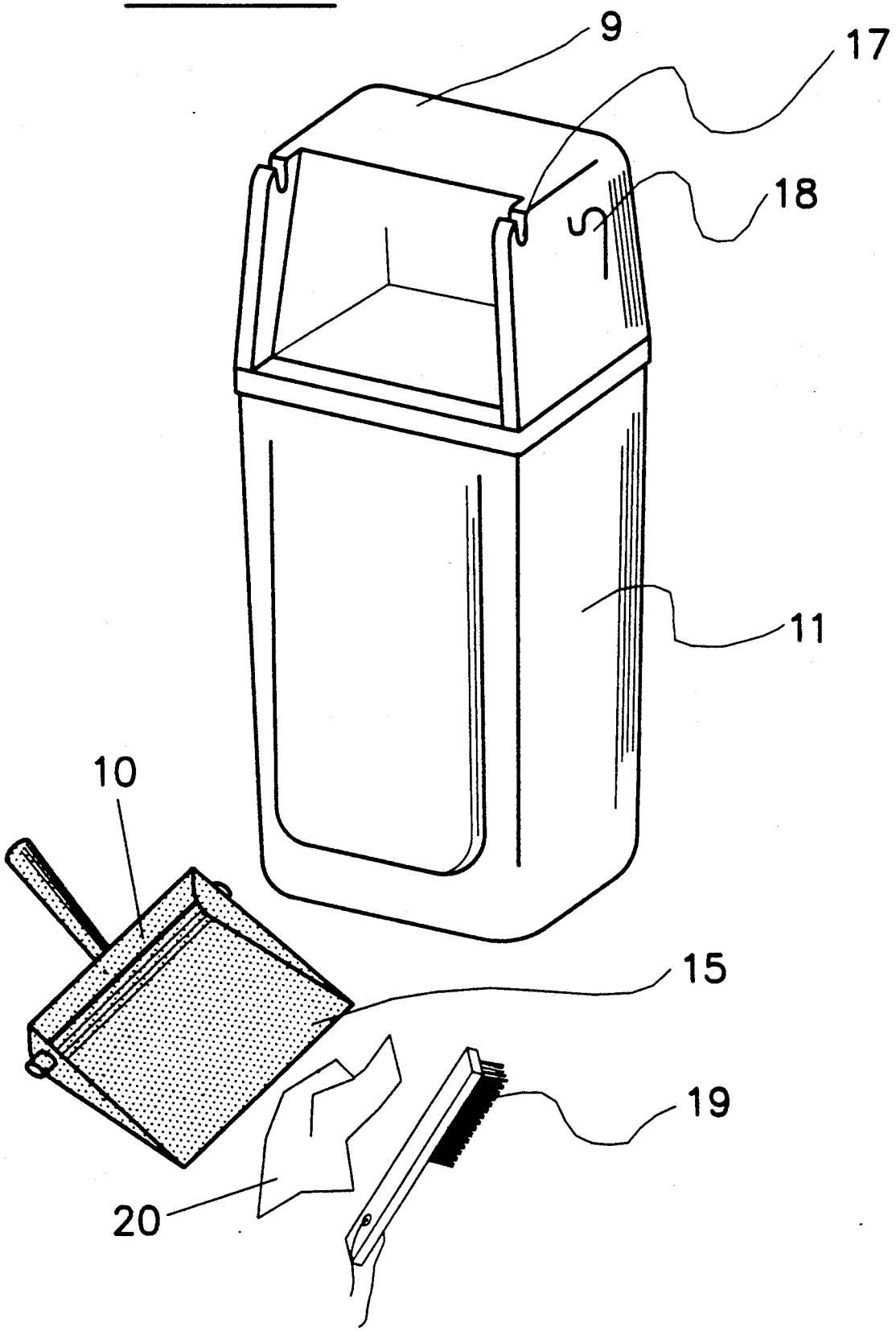
FIG. 3 is a perspective view of a dustpan and trapdoor receptacle closure during use as a dustpan together with a bonnet-type waste receptacle and brush.

Referring now to the drawings wherein is shown a preferred embodiment and wherein like reference numerals designate like elements throughout the several views, there is shown in FIG. 1 a dustpan and trapdoor receptacle closure generally designated by reference numeral 10 having means by which it is able to pivotally mount onto the bonnet 9 and adapted to fit over and cover the opening of a waste receptacle 11. Said bonnet is conveniently provided with a hook-like appendage 18 onto which a brush 19 or wiskbroom may be attached. While the waste receptacle is shown of rectangular form, of the type whose volume increases from the bottom to the top, it is understood the straight or cylindrical or square waste receptacles or bonnets may be provided with combination dustpan closures in accordance with the invention.

Figure 4:
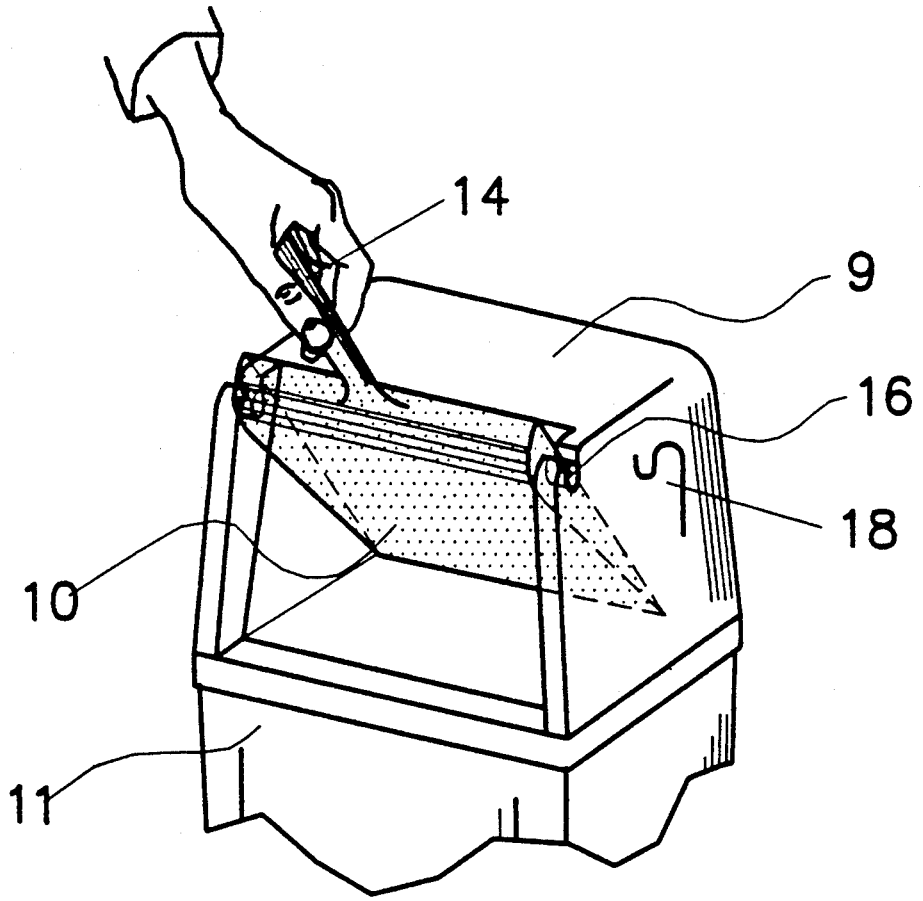
FIG. 4 is a perspective view of the dustpan and trapdoor receptacle closure pivoting during use as a trapdoor receptacle closure.

As shown in FIGS. 1 and 4 the dustpan and trapdoor receptacle closure takes the form of a rectangular concave dish adapted to be pivotally mounted in the opening of the bonnet or receptacle.

The closure is provided with a handle 14 at one end thereof to permit removal of the closure from the receptacle whereby it may be employed as a dustpan. Toward the later use, a spade-like projection generally designated by reference numeral 15 is provided. In order to enable pivotal motion, hinge pins 16 are provided on each side of the dustpan and trapdoor receptacle closure to support the closure in mating channels 17 provided in the bonnet 9 or vice versa. Said mating channel may be designed such that the closure will snap in position or simply rely on gravity to maintain position.

In accordance with the invention, the entire dustpan and trapdoor receptacle closure may be integrally molded from a suitable plastic.

It should be understood that the foregoing disclosure relates to only a preferred embodiment of the invention and that it is intended to cover all changes and modifications of the example of the invention herein chosen for the purposes of the disclosure which do not constitute departures from the spirit and scope of the invention as set forth in the claim.

I claim:

1. A fixture operative as a sanitary closure for a waste receptacle having an upper open end or as a dustpan comprising:

means whereby said fixture is pivotally attached to the open end of the receptacle when used as a closure such that said fixture pivots into the interior of said waste receptacle and can be opened against the force of entering refuse thus enabling onehanded disposal of refuse into said waste receptacle;

a handle or handles dependent from said fixture in order to enable remote and sanitary pivoting of said fixture for access to the interior of said receptacle, to facilitate removal of the fixture from said open end of said receptacle, and to grip said fixture when said fixture is used as a dustpan; and a straight edge portion integral with said fixture and extending therefrom and forming a ramp leading into the concave side of said fixture whereby when said fixture is removed from said receptacle, it may be used as a dustpan.

2. A fixture assembly operative as a sanitary closure for a waste receptacle having an upper open end or that can be disassembled, a portion of said assembly being adaptable for use as a dustpan, said fixture assembly comprising:

a bonnet having a lower open end and an upper opening, said lower open end covering the open end of the said receptacle and;

a fixture which is pivotally mounted in said upper opening in such a manner that it can be removed, said fixture comprising:

means whereby it can be pivotally attached to the open end of said bonnet when used as a closure such that said fixture pivots into the interior of said waste receptacle and can be opened against the force of entering refuse thus enabling onehanded disposal of refuse into said waste receptacle;

a handle or handles dependent from said fixture in order to enable remote and sanitary pivoting of said fixture for access to the interior of said receptacle, to facilitate removal of the fixture from said bonnet, and to grip said fixture when said fixture is used as a dustpan; and a straight edge portion integral with said fixture and extending therefrom and forming a ramp leading into the concave side of said fixture whereby when said fixture is removed from said bonnet, it may be used as a dustpan.

3. A fixture operative as a sanitary closure for a waste receptacle having an upper, substantially vertical open end or as a dustpan comprising:

means whereby it can be pivotally attached to the open end of said receptacle when used as a closure such that said fixture pivots into the interior of said waste receptacle and can be opened against the force of entering refuse thus enabling onehanded disposal of refuse into said waste receptacle;

closing means whereby the center of gravity of said fixture is located below its pivot point, thereby utilizing gravity to return said fixture to a closed position, and thus enabling said receptacle to be self-closing;

a handle or handles dependent from said fixture in order to enable remote and sanitary pivoting of said fixture for access to the interior of said receptacle, to facilitate removal of the fixture from said open end of said receptacle, and to grip said fixture when said fixture is used as a dustpan; and a straight edge portion integral with said fixture and extending therefrom and forming a ramp leading into the concave side of said fixture whereby when said fixture is removed from said receptacle, it may be used as a dustpan.

4. A fixture assembly operative as a sanitary closure for a waste receptacle having an upper open end or that can be disassembled, a portion of said assembly being adaptable for use as a dustpan, said fixture assembly comprising:

a bonnet having a lower open end and an upper substantially vertical opening, said lower open end covering the open end of the said receptacle; and, a fixture which is pivotally mounted in said substantially vertical opening in such a manner that it can be removed, said fixture comprising:

means whereby it can be pivotally attached to the open end of said receptacle when used as a closure such that said fixture pivots into the interior of said waste receptacle and can be opened against the force of entering refuse thus enabling onehanded disposal of refuse into said waste receptacle;

closing means whereby the center of gravity of said fixture is located below it's pivot point, thereby utilizing gravity to return said fixture to a closed position, and thus enabling said receptacle to be self-closing;

a handle or handles dependent from said fixture in order to enable remote and sanitary pivoting of said fixture for access to the interior of said receptacle, to facilitate removal of the fixture from said bonnet, and to grip said fixture when said fixture is used as a dustpan; and a straight edge portion integral with said fixture and extending therefrom and forming a ramp leading into the concave side of said fixture whereby when said fixture is removed from said bonnet, it may be used as a dustpan.

5. A fixture operative as a sanitary closure for a waste receptacle having an upper open end or as a dustpan comprising:

means whereby it can be pivotally attached to the open end of said receptacle when used as a closure such that said fixture pivots into the interior of said waste receptacle and can be opened against the force of entering refuse thus enabling onehanded disposal of refuse into said waste receptable;

closing means utilizing potential and kinetic energy whereby said fixture is urged closed when at rest by virtue of its seeking its lowest energy state, said energy state being of a range of magnitude which can readily be overcome by hand pressure thereby allowing the relatively effortless pivoting of said fixture for access to the inside of said receptacle, said pivoting of said fixture resulting in the increase in its potential energy and therefore an increase in said energy which may be converted to kinetic energy to close said receptacle when said fixture is released;

a handle or handles dependent from said fixture in order to enable remote and sanitary pivoting of said fixture for access to the interior of said receptacle, to facilitate removal of the fixture from said open end of said receptacle, and to grip said fixture when said fixture is used as a dustpan; and a straight edge portion integral with said fixture and extending therefrom and forming a ramp leading into the concave side of said fixture whereby when said fixture is removed from said receptacle, it may be used as a dustpan.

* * * * *